US007688170B2

(12) United States Patent
Pauley, Jr. et al.

(10) Patent No.: US 7,688,170 B2
(45) Date of Patent: Mar. 30, 2010

(54) TRANSFORMER COIL ASSEMBLY

(75) Inventors: William E. Pauley, Jr., Bland, VA (US); Rush Horton, Jr., Wytheville, VA (US); Curtis Frye, Saltville, VA (US); Charlie H. Sarver, Rocky Gap, VA (US)

(73) Assignee: ABB Technology AG, Zurich (CH)

( * ) Notice: Subject to any disclaimer, the term of this patent is extended or adjusted under 35 U.S.C. 154(b) by 924 days.

(21) Appl. No.: 10/858,039

(22) Filed: Jun. 1, 2004

(65) Prior Publication Data

US 2005/0275496 A1 Dec. 15, 2005

(51) Int. Cl.
*H01F 27/30* (2006.01)

(52) U.S. Cl. ..... 336/185

(58) Field of Classification Search ..... 336/185
See application file for complete search history.

(56) References Cited

U.S. PATENT DOCUMENTS

| | | | | |
|---|---|---|---|---|
| 1,495,823 | A * | 5/1924 | Underhill | 336/206 |
| 3,234,493 | A * | 2/1966 | Zwelling et. al. | 336/94 |
| 3,711,807 | A * | 1/1973 | Yamashita et al. | 336/205 |
| 3,946,350 | A * | 3/1976 | Goto | 336/208 |
| 4,264,887 | A * | 4/1981 | Barrett | 335/291 |
| 6,160,464 | A * | 12/2000 | Clarke et al. | 336/60 |

FOREIGN PATENT DOCUMENTS

EP 0 071 090 A1 2/1983

OTHER PUBLICATIONS

An Approach To The Spacer Design Of HVAC SF6 Gas Insulated Equipment, V.N. Varivodov et al, 7th International Symposium on High Voltage Engineering, Aug. 26-30, 1991, pp. 41-44.

Systematic Analysis Of Characteristics For Different Types Of Multilayer Insulations, M. Taneda et al., Mechanical Engineering Research Laboratory, 1988, Kobe, Japan, pp. 305-311.

Degradation Mechanisms For Epoxy Insulators Exposed To $SF_6$ Arcing Byproducts, F.Y. Chu et al., Conference Record of 1986 IEEE International Symposium On Electrical Insulation, Washington, DC Jun. 9-11, 1986, pp. 306-309.

Charge Accumulation On Spacer Surface At DC Stress In Compressed $SF_6$ Gas, K. Nakanishi et al., Central Research Lab and Itami Works, 1982, Hyogo, Japan, pp. 365-373.

(Continued)

*Primary Examiner*—Elvin G Enad
*Assistant Examiner*—Joselito Baisa
(74) *Attorney, Agent, or Firm*—Paul R. Katterle; Burns, Doane, Swecker and Mathis

(57) ABSTRACT

A transformer coil assembly includes a first layer having a plurality of fibers interconnected to form a fabric and a plurality of spacers. Each spacer is affixed on a first side of the spacer to the fabric and protruding from a first surface of the fabric. A second layer has a conductor in contact with at least one of the plurality of spacers on a second side of each spacer that opposes the first side. The first and second layers are covered by resin.

13 Claims, 7 Drawing Sheets

OTHER PUBLICATIONS

Surface Charging On Epoxy Spacer at DC Stress In Compressed $SF_6$ Gas, K. Nakanishi et al, IEEE Transactions on Power Apparatus And Systems, vol. PAS-102, No. 12, Dec. 1983, pp. 3919-3927.

Characterization of Degraded Epoxy Spacer Surfaces by Electron Spectroscopy, J.M. Braun et al., Toronto, Canada, 1984 pp. 89-95.

Partial Discharge Characteristics Leading To Breakdown of GIS Spacer Samples With Degraded Insulation Performances, N. Hayakawa et al, 7$^{th}$ International Conference on Properties and Applications of Dielectric Materials, Jun. 1-5, 2003, Nagoya, pp. 65-68.

Partial Discharge Current Pulse Waveform Analysis (CPWA) For Electrical Insulation Diagnosis Of Solid Insulators in GIS, A. Matsushita et al., 2001 Annual Report Conference on Electrical Insulation and Dielectric Phenomena, pp. 348.

An Insulating Grid Spacer For Large-area Micromegas Chambers, D. Bernard et al., Nuclear Instruments and Methods in Physics Research A 481 (2002) pp. 144-148.

Partial Discharge Characteristics of Long-Term Operated 550kV GCB Epoxy Spacer, S. Watanabe et al., 2002 Annual Report Conference on Electrical Insulation and Dielectric Phenomena, pp. 462.

Partial Discharge: Overview and Signal Generation, Steven Boggs, Underground Systems, Inc., Jul./Aug. 1990, pp. 33-39.

Reliability of Epoxy Spacer For EHV-Class Gas Insulated Switchgear, D.I. Yang et al, 2001 IEEE 7$^{th}$ International Conference on Solid Dielectrics, Jun. 25-29, 2001, Eindhoven, the Netherlands, pp. 121-124.

The Role of Spacer Surface Conditions in the Scatter of Charge Accumulations in $SF_6$, T. Jing., Proceedings of the 4$^{th}$ International Conference on Properties and Applns. Of Dielectric Materials, Jul. 3-8, 1994, pp. 274.

Characteristics of Charging on a Epoxy Spacer Under DC Voltage, Y. Yoshio et al., vol. 118A, No. 6, Jun. 1998, English Abstract only.

* cited by examiner

TRANSFORMER COIL ASSEMBLY

BACKGROUND

Transformer coils used in high-voltage and other applications are formed by winding a conductor and casting and curing a thermosetting resin composition around the conductor windings to form a resin body covering the coil. The resin body provides dielectric properties to the transformer coil assembly, as well as holding the conductor windings in place. The resin also provides protection and more uniform thermal properties to the coil assembly. Without some form of support structure for the coil assembly, the resin may develop cracks during casting or during use when the assembly is subjected to external conditions, such as high temperature, high humidity, moisture penetration and the like, or due to internal factors, such as heat generation or stress due to high current flow, electrical fault conditions, and the like.

The resin body is subjected to thermal forces from coil temperatures well above ambient during operation due to $I^2R$ losses in the conductors, from eddy currents, from hysteresis losses in the core, and from stray flux impinging the axial ends of the windings. Further, the resin body may be subject to vibratory forces during operation. The resin body should satisfactorily restrain, resist, and withstand all of these forces over long term operation.

SUMMARY

A transformer coil assembly is disclosed that includes a first layer having a plurality of fibers interconnected to form a fabric and a plurality of spacers. Each spacer is affixed on a first side of the spacer to the fabric and protruding from a first surface of the fabric. A second layer has a conductor in contact with at least one of the plurality of spacers on a second side of each spacer that opposes the first side. The first and second layers are covered by resin.

A method of forming a transformer coil assembly is disclosed that includes providing a first fabric layer having a plurality of fibers interconnected and a plurality of protruding spacers affixed to a surface of the fabric. A conductor layer is applied to the first fabric layer in contact with at least one of the plurality of protruding spacers. A resin is applied to cover at least the first fabric layer and the conductor layer.

A transformer coil assembly is disclosed that includes means for establishing a support structure for the transformer coil assembly, the support structure having a first thickness along a first dimension. Spacer means are affixed to the support structure and have a second thickness along the first dimension, the second thickness being greater than the first thickness. The spacer means are formed of a material having a lower compressibility than material used to form the support structure. Conductor means are in contact with the spacer means. Dielectric means cover the support structure means, the spacer means, and the conductor means.

A fibrous material for reinforcing a resin cast transformer coil assembly is disclosed that includes a plurality of fibers interconnected to form a fabric. A plurality of spacers is affixed to the fabric and protrudes from a surface of the fabric. The spacers are arranged in a plurality of rows, where each row is segmented such that superimposing rows onto each other provides an unsegmented row of spacers.

BRIEF DESCRIPTION OF THE DRAWINGS

Objects and advantages will become apparent to those skilled in the art upon reading this description in conjunction with the accompanying drawings, in which like reference numerals have been used to designate like elements, and in which.

DETAILED DESCRIPTION

Figure 1:
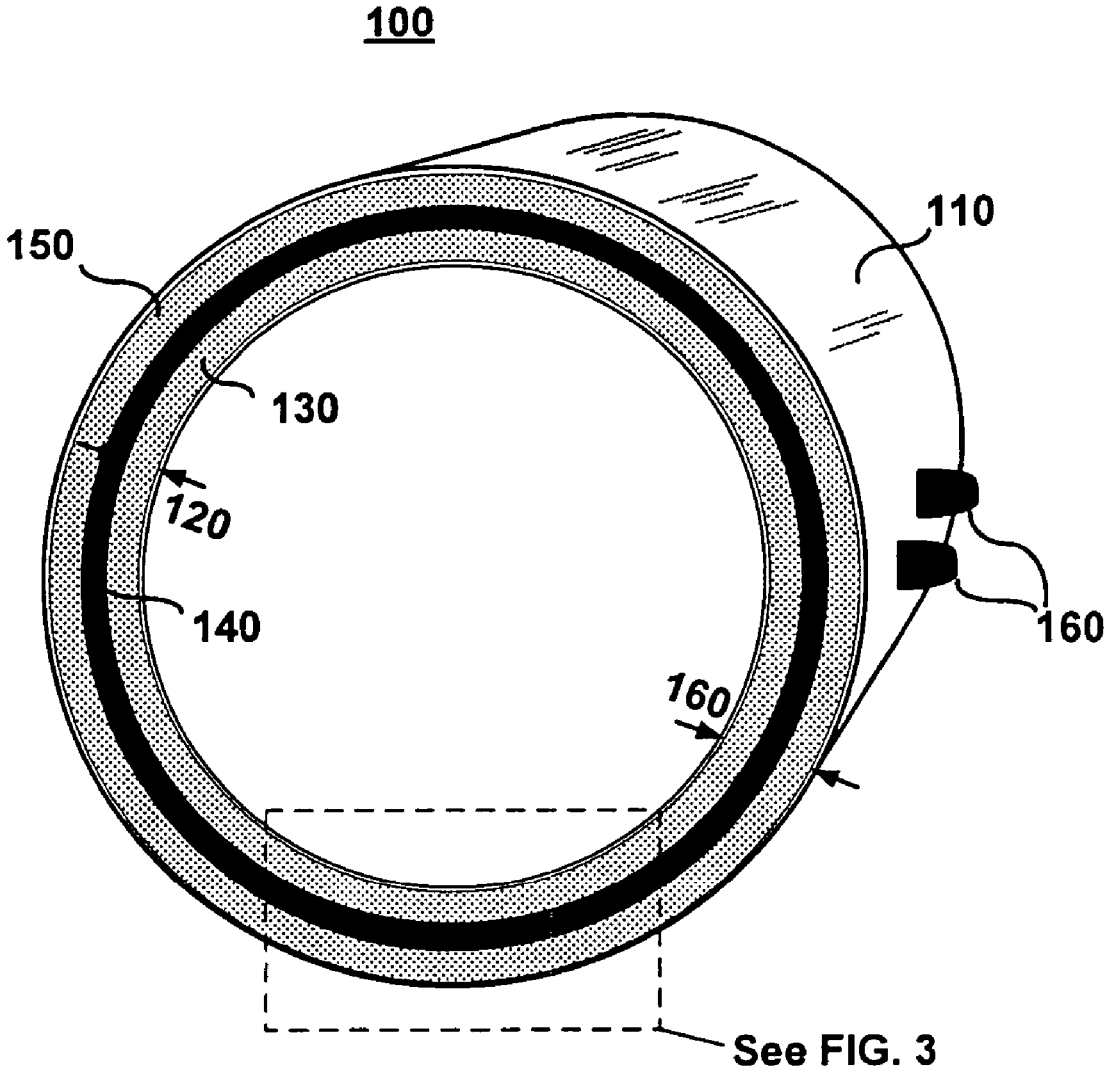
FIG. 1 is a perspective view of a transformer coil assembly.
Figure 3:
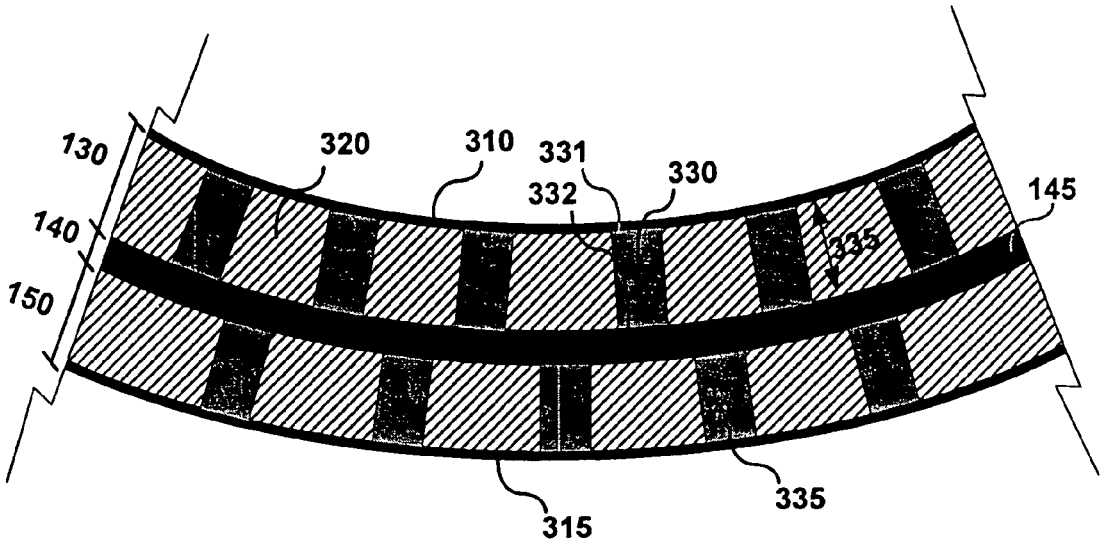
FIG. 3 shows an area of detail of the transformer coil assembly of FIG. 1.

FIG. 1 is a perspective view of a transformer coil assembly 100 according to an exemplary embodiment. The transformer coil assembly 100 includes a first layer 130 and a second layer 140. Referring also to FIG. 3, which details an area of the transformer coil assembly 100 of FIG. 1, a first layer 130 of the transformer coil assembly 100 includes means for establishing a support structure 310.

The means for establishing a support structure 310 can include multiple fibers interconnected to form a fabric. The fabric can include glass fibers and can include electrical grade glass. The fabric can include any of a variety of fibers that are known in this art to be suitable for transformer cast applications, such as polyphenylene sulfide (PPS), polyamides (nylon), polyvinyl chloride (PVC), flouropolymers (PTFE), and the like.

The first layer 130 of the transformer coil assembly 100 also includes spacer means 330, affixed to the support structure means 310. The spacer means 330 can include multiple spacers and is preferably formed of a less compressive material than fabric, such as resin or epoxy. The spacer means 330 are affixed to a surface of the support structure means 310. Here, the term "affixed" means that the spacers can be secured adjacent to a surface of the support structure means 310, by adhesives or other known means, or can be partially embedded in the support structure means 310. The spacer means 330 protrude from the support structure means 310 by a distance, i.e., height, 335. It should be appreciated that although the spacer means 330 are shown affixed to only one surface of the support structure means 310, the spacer means 330 can also be attached to both opposing surfaces of the support structure means 310.

The second layer 140 includes a conductor means 145 in contact with at least one of the spacers of the spacer means 330 on a second side 332 of each spacer that opposes the first side 331. The conductor means 145 can be a single conductor that is wound continuously to form a single transformer coil winding, or can be multiple conductors, depending on the type of transformer coil assembly 100. The conductor means 145 can include tabs 160 for accessing the conductor means 145 by other electrical components outside the transformer coil assembly 100.

The transformer coil assembly 100 includes a dielectric means for covering the support structure means 310, the spacer means 330, and the conductor means 145. The dielectric means can be a resin body 110 covering the layers of the transformer coil assembly 100. Although the dielectric means will be described hereinafter as a resin body 110, or simply resin 110, one of skill in this art will recognize that a number of dielectric materials may be used that are suitable for use in a transformer cast. The thickness of the resin body should be uniform to provide dielectric properties that are uniform throughout the transformer coil assembly. Here, the term uniform means substantially the same throughout with some tolerance. A dielectric with favorable properties will resist breakdown under high voltages, does not itself draw appreciable power from the circuit, is physically stable, and has characteristics that do not vary much over a fairly wide temperature range.

The transformer coil assembly 100 can optionally include a third layer 150 having support structure means 315 and spacer means 335. The third layer 150 can be made of the same materials as the first layer, although this is not a requirement. When the optional third layer 150 is employed, the dielectric means, such as a resin body 110, can cover the first, second, and third layers 130, 140, 150, providing an overall thickness 160.

The means for establishing support structure 310 provides reinforcing support to the resin body 110 to prevent the development of cracks during casting or during use when the assembly is subjected to external conditions, such as high temperature, high humidity, moisture penetration and the like, or due to internal factors, such as high coil temperatures or vibratory forces during operation.

The spacer means 330 protrude from the support structure means 310 by a distance 335. The protrusion of the spacer means 330 creates a space 320 between conductor means 145 and the support structure means 310, where the resin 110 can more easily flow during the casting process. That is, without the spacers, the resin would have to "wick" into the support structure, which takes additional time and may produce uneven dispersion of the resin 110. Uneven dispersion produces a resin body 110 that does not have uniform dielectric properties. The spacer means 330 provides a more even resin body 110 having more uniform dielectric properties than using, for example, a support structure 310 only.

Moreover, the height 335 of the spacer means 330 can be selected to provide a desired overall thickness 120 of the first layer 130 using less support structure means 310, such as fabric. That is, to achieve the same thickness 120 of the first layer 130, and therefore the same dielectric properties, without the spacer means 330, many layers of fabric would typically be required. The layers of fabric would not only cause uneven dispersing of the resin 110, as described above, but would be subject to compression by the conductor means 145 as the conductor means 145 is applied, e.g., wound, over the fabric layers. Compression is typically uneven and results in a non-uniform thickness of the first layer, causing non-uniform dielectric properties. The spacer means 330 therefore preferably is less compressive, i.e., is less subject to changes in volume when a force is applied, than the support structure means 310. For example, epoxy spacers are less compressive than layers of electrical grade glass.

Figure 2:
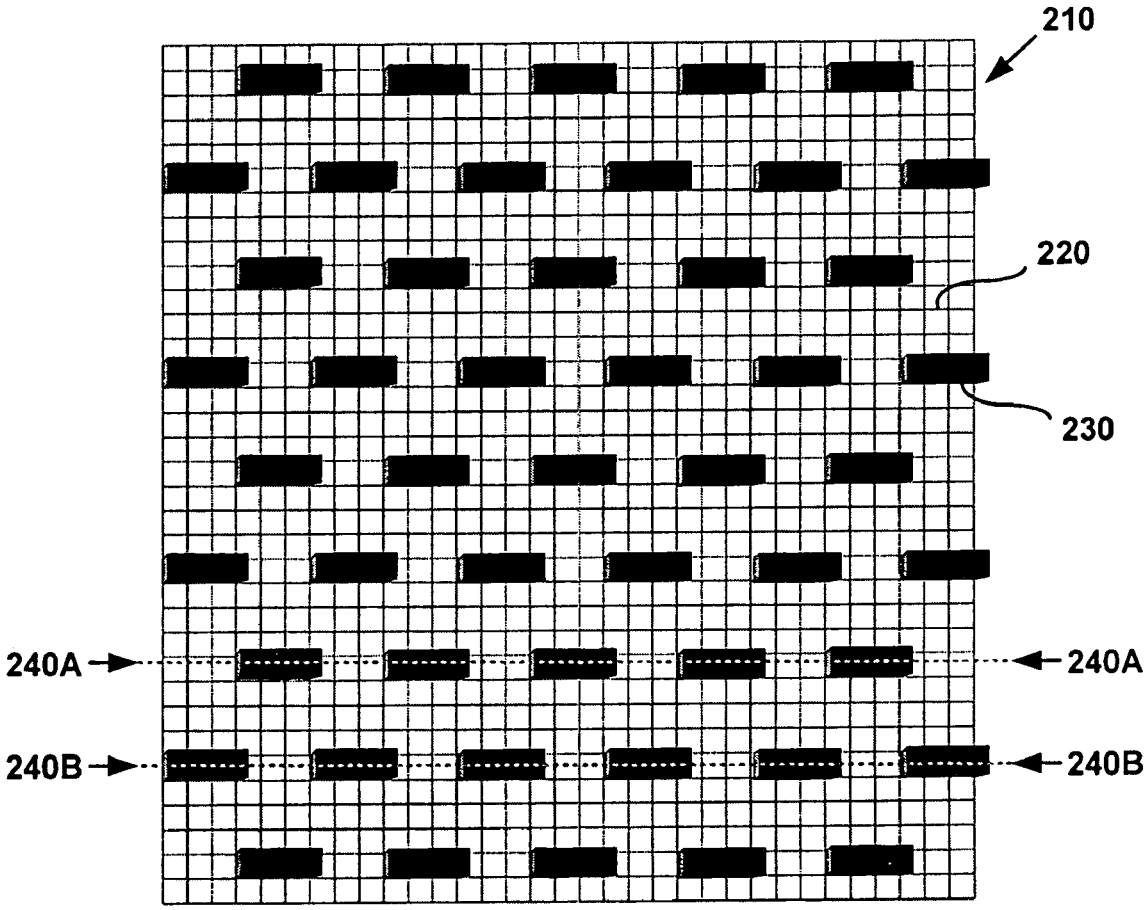
FIG. 2 shows a support structure and spacers.

FIG. 2 shows a support structure 210 with spacers 230. The support structure 210 includes a plurality of fibers 220 interconnected to form a fabric. Although a grid-like pattern is illustrated, any pattern can be used. Multiple spacers 230 are affixed to the fabric 210 and protruding from a surface of the fabric 210.

The spacers 230 can be arranged in a plurality of rows 240A, 240B. The rows 240A, 240B can be segmented as shown. FIG. 2 shows the spacers 230 arranged in one of many patterns that can be used. FIGS. 5A-5D show other possible patterns of the spacers that can be used.

Figure 4B:
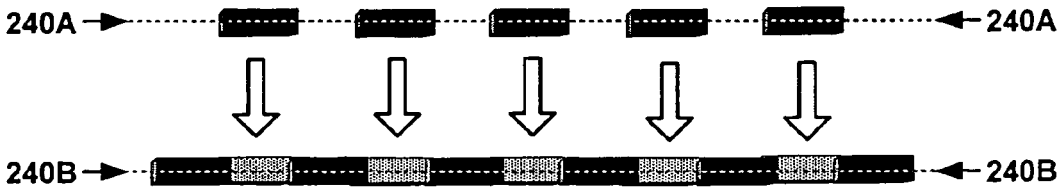
FIG. 4B illustrates a feature of a spacer pattern of FIG. 4A.
Figure 4A:
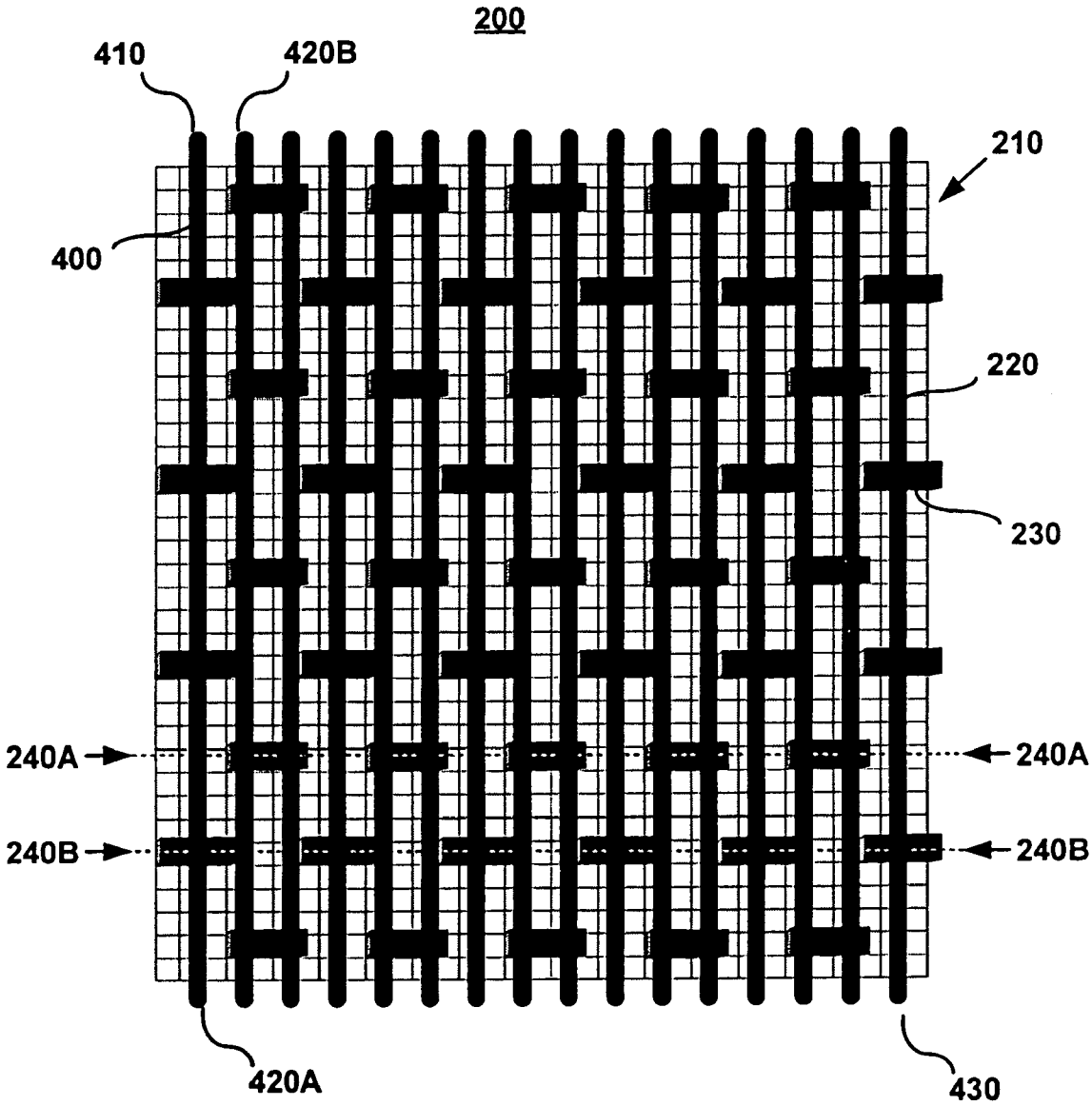
FIG. 4A shows a support structure, spacers, and a conductor.

FIG. 4A shows a support structure, spacers, and a conductor. The spacers 230 are shown arranged in a plurality of rows 240A, 240B. A conductor 430 has a first end 410 and a second end 430 and is continuous such that segment ends 420A and 420B are connected, i.e., represent the same point, and so on. The spacers 230 are shown arranged in a pattern so that the conductor 430 contacts only the spacers 230, and contacts a spacer 230 at least every two rows. This pattern provides support for the conductor 430 every two rows.

Figure 5A:
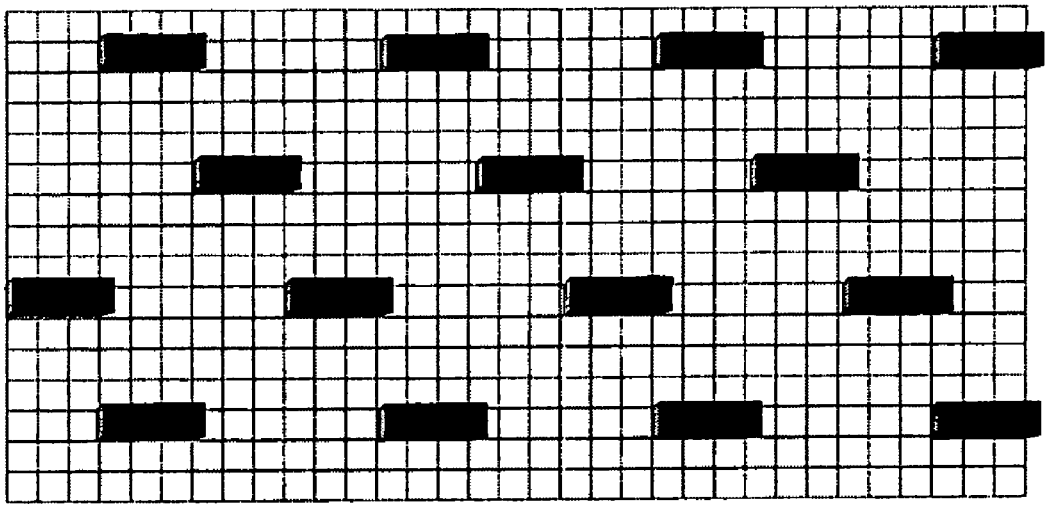
FIGS. 5A-5D show other possible arrangements of the spacers.
Figure 5B:
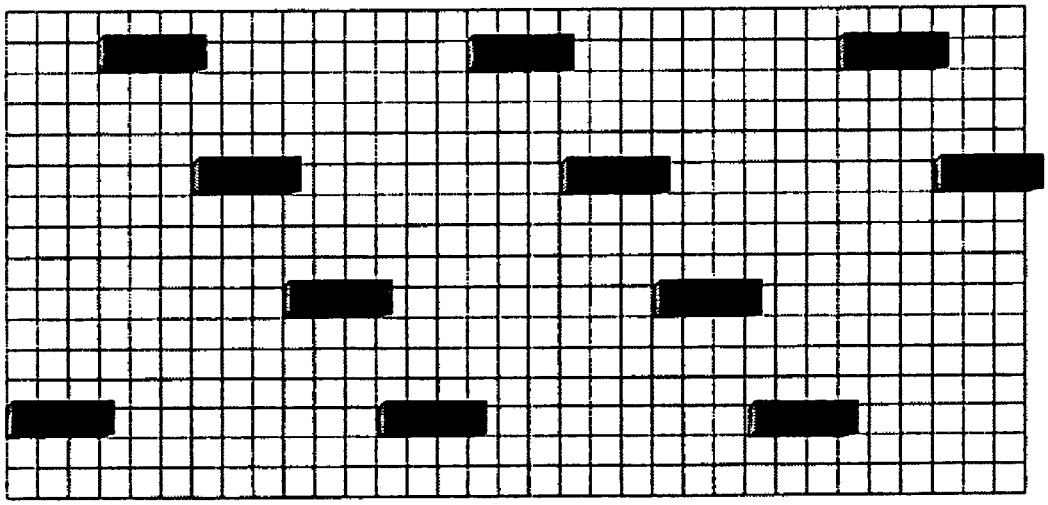

FIG. 4B illustrates this feature of the spacer pattern of FIG. 4A. The superimposition of row 240A onto 240B provides an unsegmented row of spacers. Here, the term "unsegmented" is meant to include both a contiguous row of adjacent spacers and a row of overlapping spacers. This feature helps define the pattern of FIG. 4A. Likewise, as can be appreciated, in the pattern of FIG. 5A, the superimposition of three rows onto each other provides an unsegmented row of spacers. In FIG. 5B, the superimposition of four rows onto each other provides an unsegmented row of spacers. In FIGS. 5A and 5B, the respective pattern provides support for the conductor 430 every three rows and every four rows. This can be expanded to any number of rows.

Figure 5C:
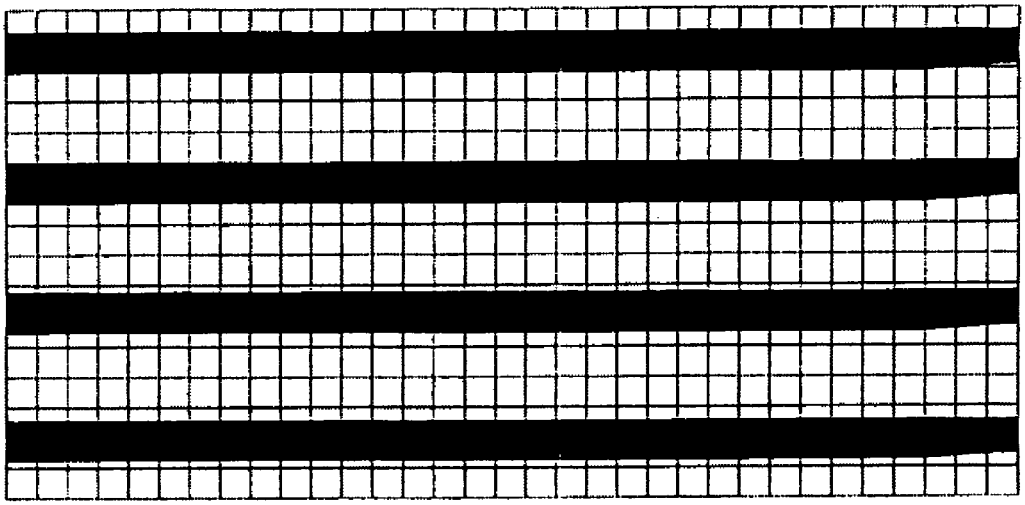
Figure 5D:
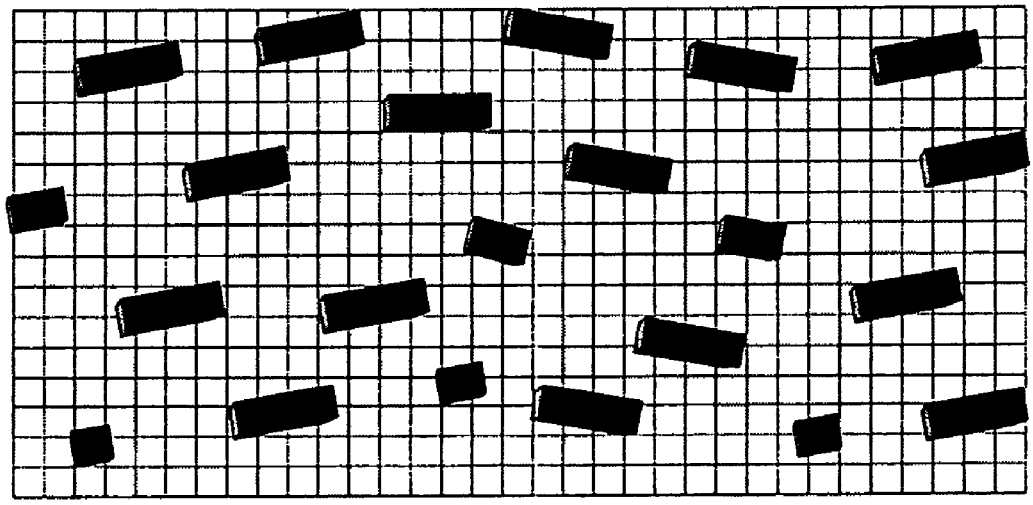

As can be appreciated from FIG. 5C, the rows need not be segmented, although it is preferable as discussed below. Moreover, as can be appreciated from FIG. 5D, the spacers can be of varying sizes and patterns, and need not be in rows. The spacer pattern can be purely random if desired.

It is, however, preferable to use segmented rows of spacers. The segmenting allows better flow of the resin around the spacers. In addition, longer spacers are more likely to conduct electricity from one area of the conductor to another, or create a voltage potential between spacers.

Figure 6:
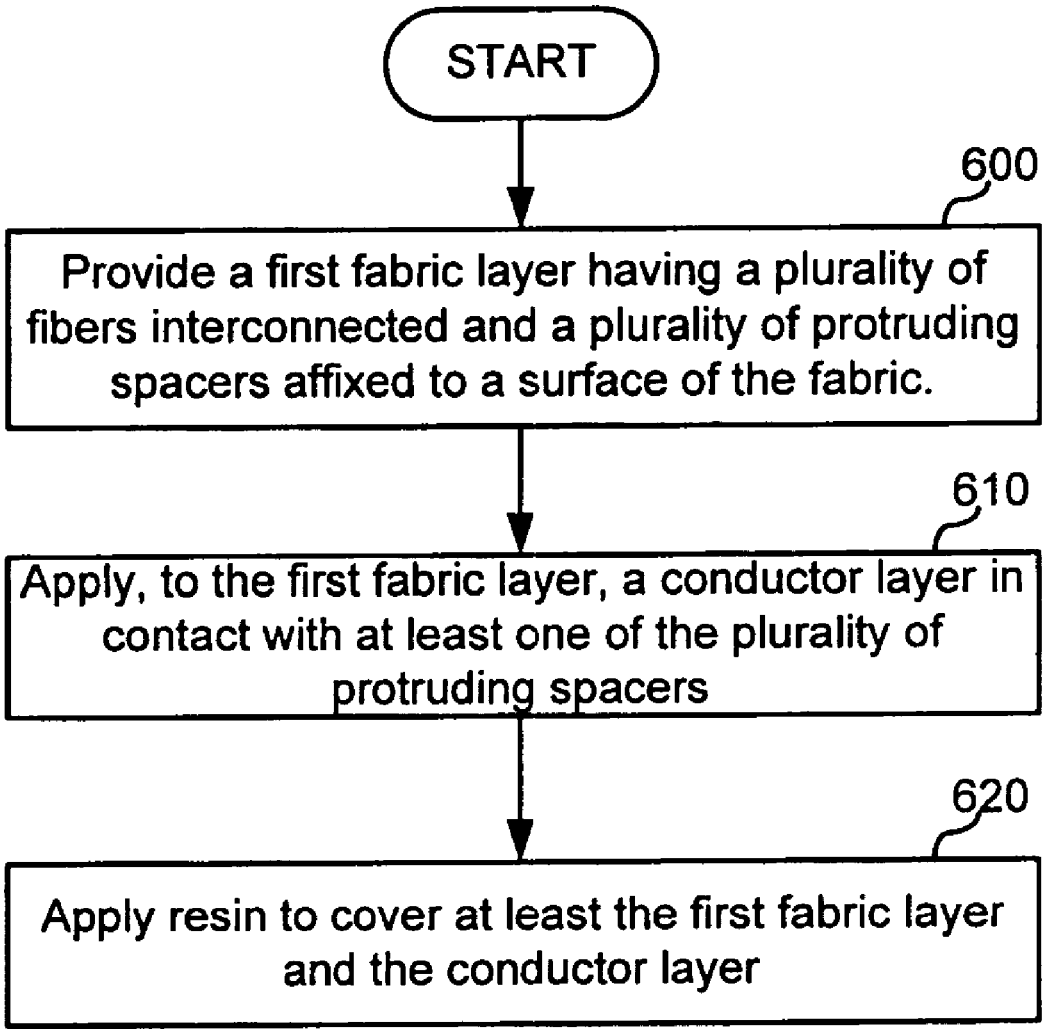
FIG. 6 is a flow chart illustrating a method of forming a transformer coil assembly.

FIG. 6 is a flow chart illustrating a method of forming a transformer coil assembly. A method of forming a transformer coil assembly includes providing a first fabric layer having a plurality of fibers interconnected and a plurality of protruding spacers affixed to a surface of the fabric (600). A conductor layer is applied to the first fabric layer in contact with at least one of the plurality of protruding spacers (610). A resin is applied to cover at least the first fabric layer and the conductor layer (620).

It will be appreciated by those of ordinary skill in the art that the invention can be embodied in various specific forms without departing from its essential characteristics. The disclosed embodiments are considered in all respects to be illustrative and not restrictive. The scope of the invention is indicated by the appended claims, rather than the foregoing description, and all changes that come within the meaning and range of equivalents thereof are intended to be embraced thereby.

It should be emphasized that the terms "comprises", "comprising", "includes" and "including" when used in this description and claims, are taken to specify the presence of stated features, steps, or components, but the use of these terms does not preclude the presence or addition of one or more other features, steps, components, or groups thereof.

What is claimed is:

1. A transformer coil assembly, comprising:

a first layer having a plurality of fibers interconnected to form a fabric and a plurality of rows of spaced-apart spacers, each spacer affixed on a first side of the spacer to the fabric and protruding from a first surface of the fabric;

a second layer having a conductor in contact with at least one of the spacers in each row on a second side of each spacer that opposes the first side; and a resin body covering the first and second layers.

2. The transformer coil assembly of claim 1, comprising:

a third layer having a plurality of fibers interconnected to form a fabric and a row of spaced-apart spacers, each spacer affixed on a first side of the spacer to the fabric and protruding from a surface of the fabric to contact the conductor on a second side of each spacer, and wherein the resin body covers the first, second, and third layers.

3. The transformer coil assembly of claim 1, wherein an average distance along a surface of the fabric between adjacent spacers is greater than an average distance along a surface of the fabric between adjacent interconnected fibers.

4. The transformer coil assembly of claim 1, wherein the plurality of interconnected fibers comprises glass fibers.

5. The transformer coil assembly of claim 4, wherein the glass fibers comprise electrical grade glass.

6. The transformer coil assembly of claim 1, wherein the spacers comprise resin.

7. The transformer coil assembly of claim 1, wherein the spacers comprise epoxy.

8. The transformer coil assembly of claim 1, wherein the spacers are partially embedded into the fabric.

9. The transformer coil assembly of claim 1, wherein the rows of spacers comprise a plurality of first rows and a plurality of second rows, wherein the spacers in the first rows are offset from the spacers in the second rows, and wherein the first rows and the second rows are arranged in an alternating manner.

10. The transformer coil assembly of claim 1, wherein in each turn of the conductor, the conductor only contacts every other row of spacers.

11. The transformer coil assembly of claim 1, wherein the spacers are affixed to the fabric before the resin body is formed.

12. The transformer coil assembly of claim 1, wherein each row of spacers extends in a direction perpendicular to the direction of the conductor.

13. The transformer coil assembly of claim 1, wherein each row of spacers extends in an axial direction of the transformer coil assembly.

* * * * *